US007188390B2

(12) United States Patent
Cheng

(10) Patent No.: US 7,188,390 B2
(45) Date of Patent: Mar. 13, 2007

(54) ADJUSTABLE HINGE FOR A GLASS DOOR

(76) Inventor: Ko-Ming Cheng, No. 9-60, Hsi-Liao Rd., Hsi-Liao Village, Ta-Liao Hsiang, Kaohsiung Hsien (TW)

( * ) Notice: Subject to any disclaimer, the term of this patent is extended or adjusted under 35 U.S.C. 154(b) by 219 days.

(21) Appl. No.: 11/080,911

(22) Filed: Mar. 15, 2005

(65) Prior Publication Data

US 2006/0207060 A1 Sep. 21, 2006

(51) Int. Cl.
*E05D 5/02* (2006.01)

(52) U.S. Cl. ..... 16/252; 16/241; 16/245; 16/235; 16/382

(58) Field of Classification Search ..... 16/252, 16/235, 238, 240, 241, 245, 382, 334; 49/397–399, 49/381; 160/199, 206, 208, 210, 213; 4/556, 4/557, 607, 614
See application file for complete search history.

(56) References Cited

U.S. PATENT DOCUMENTS

| | | | | |
|---|---|---|---|---|
| 3,475,783 | A | 11/1969 | Jorgensen | |
| 5,004,062 | A | 4/1991 | Foot | |
| 5,867,869 | A * | 2/1999 | Garrett et al. | 16/252 |
| 6,070,294 | A * | 6/2000 | Perkins et al. | 16/252 |
| 6,481,055 | B2 * | 11/2002 | Cheng | 16/252 |
| 6,519,811 | B1 * | 2/2003 | Cheng | 16/252 |
| 6,704,966 | B1 * | 3/2004 | Kao | 16/252 |
| 6,766,561 | B1 * | 7/2004 | Cheng | 16/235 |
| 6,826,870 | B2 | 12/2004 | Chiang | |
| 7,010,832 | B2 * | 3/2006 | Chen | 16/252 |
| 7,114,292 | B2 * | 10/2006 | Chiang | 49/388 |
| 2002/0116787 | A1 * | 8/2002 | Miller et al. | 16/252 |
| 2002/0144377 | A1 | 10/2002 | Cheng | |
| 2005/0071952 | A1 | 4/2005 | Chen | |
| 2005/0125949 | A1 * | 6/2005 | Lin | 16/248 |

FOREIGN PATENT DOCUMENTS

| | | | |
|---|---|---|---|
| DE | 19742143 | C1 * | 11/1998 |
| EP | 620347 | B1 * | 8/1997 |
| EP | 867586 | A2 * | 9/1998 |
| EP | 1319359 | A2 * | 6/2003 |

* cited by examiner

*Primary Examiner*—Chuck Y. Mah
(74) *Attorney, Agent, or Firm*—Hershkovitz & Associates; Abe Hershkovitz

(57) ABSTRACT

An adjustable hinge is mounted on a doorframe, holds a glass door and has a stationary bracket and a clamp assembly. The stationary bracket is mounted securely on the doorframe and has a sliding actuator. The clamp assembly is mounted rotatably on the stationary bracket and has a first clamp assembly and a second clamp securely holding the glass door and two pairs of pivot pin clamp bolts. The first clamp assembly has a body, a pivot pin mounted rotatably through the stationary bracket and two pivot pin clamps securely holding the body on the pivot pin. The pivot pin clamp bolts securely hold the pivot pin clamps on the body of the first clamp assembly. The glass door is aligned with the doorframe by releasing the pivot pin clamp bolts and loosing the pivot pin clamps to align the sliding actuator and the pivot pin.

6 Claims, 8 Drawing Sheets

ADJUSTABLE HINGE FOR A GLASS DOOR

BACKGROUND OF THE INVENTION

1. Field of the Invention

The present invention relates to a hinge, and more particularly to an adjustable hinge for a glass door that can be adjusted exactly and quickly to precisely align the glass door with a doorframe on which the adjustable hinge is pivotally mounted.

2. Description of Related Art

Hinges are used generally with a glass door to pivotally mount the glass door in a doorframe.

Conventional hinges are mounted between a doorframe and a glass door having a front surface and a rear surface, and each hinge has a stationary bracket and two clamps. The stationary bracket is attached securely to the doorframe. The clamps are attached pivotally to the stationary bracket, are separated from each and are mounted respectively on the front and rear surfaces of the glass door to securely hold the glass door.

However, slight inaccuracies in the dimensions of the glass door and the doorframe and attaching the hinges to the door or the doorframe cause the glass door to misalign slightly with the doorframe when the glass door is closed. Therefore, hinges have been developed with an adjuster to align the glass door with the doorframe.

However, the operation of the adjuster of the hinge is complex and time-consuming.

To overcome the shortcomings, the present invention provides an adjustable hinge for a glass door to mitigate or obviate the aforementioned problems.

SUMMARY OF THE INVENTION

The main objective of the invention is to provide an adjustable hinge for a glass door that is adjusted quickly and easily to precisely align the glass door with a doorframe to which the adjustable hinge is attached.

An adjustable hinge in accordance with the present invention is mounted on a doorframe, holds a glass door and comprises a stationary bracket and a clamp assembly.

The stationary bracket is attached securely to the doorframe and has a doorframe mount, a pivot pin bracket, a sliding actuator and at least one resilient element.

The clamp assembly is attached pivotally to the stationary bracket and has a first clamp assembly, a second clamp and two clamp bolts. The first clamp assembly and the second clamp securely hold the glass door.

The first clamp assembly has a body, a pivot pin, two pivot pin clamps and two pairs of pivot pin clamp bolts. The body has two pivot pin sockets and two threaded clamp holes. The pivot pin is mounted securely in the pivot pin sockets and rotatably through the pivot pin bracket in the stationary bracket. The pivot pin clamps securely hold the pivot pin on the first clamp. The pairs of pivot pin clamp bolts securely hold the pivot pin clamps respectively in the pivot pin sockets.

Other objectives, advantages and novel features of the invention will become more apparent from the following detailed description when taken in conjunction with the accompanying drawings.

DETAILED DESCRIPTION OF PREFERRED EMBODIMENT

Figure 1:
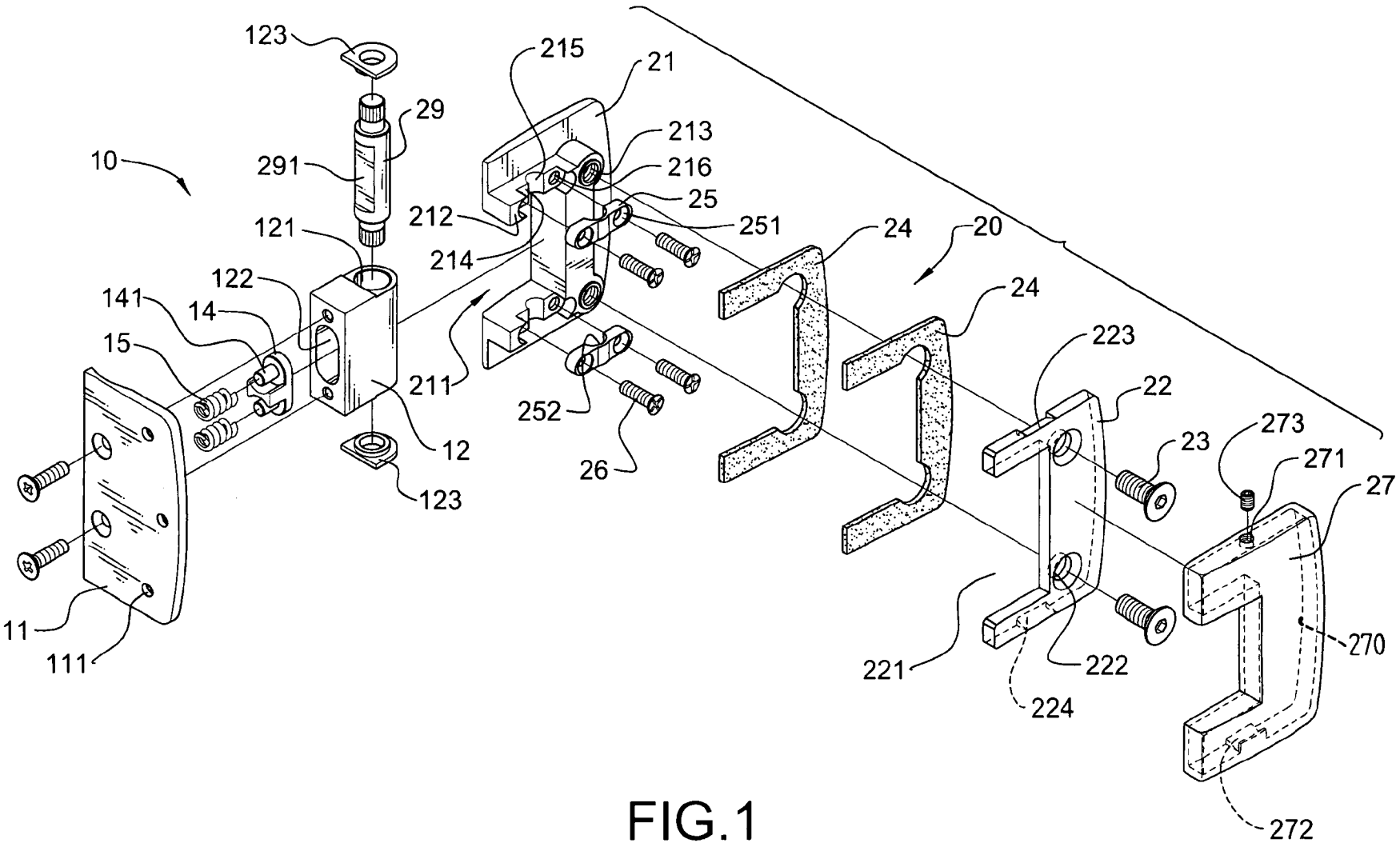
FIG. 1 is an exploded perspective view of an adjustable hinge for a glass door in accordance with the invention.
Figure 2:
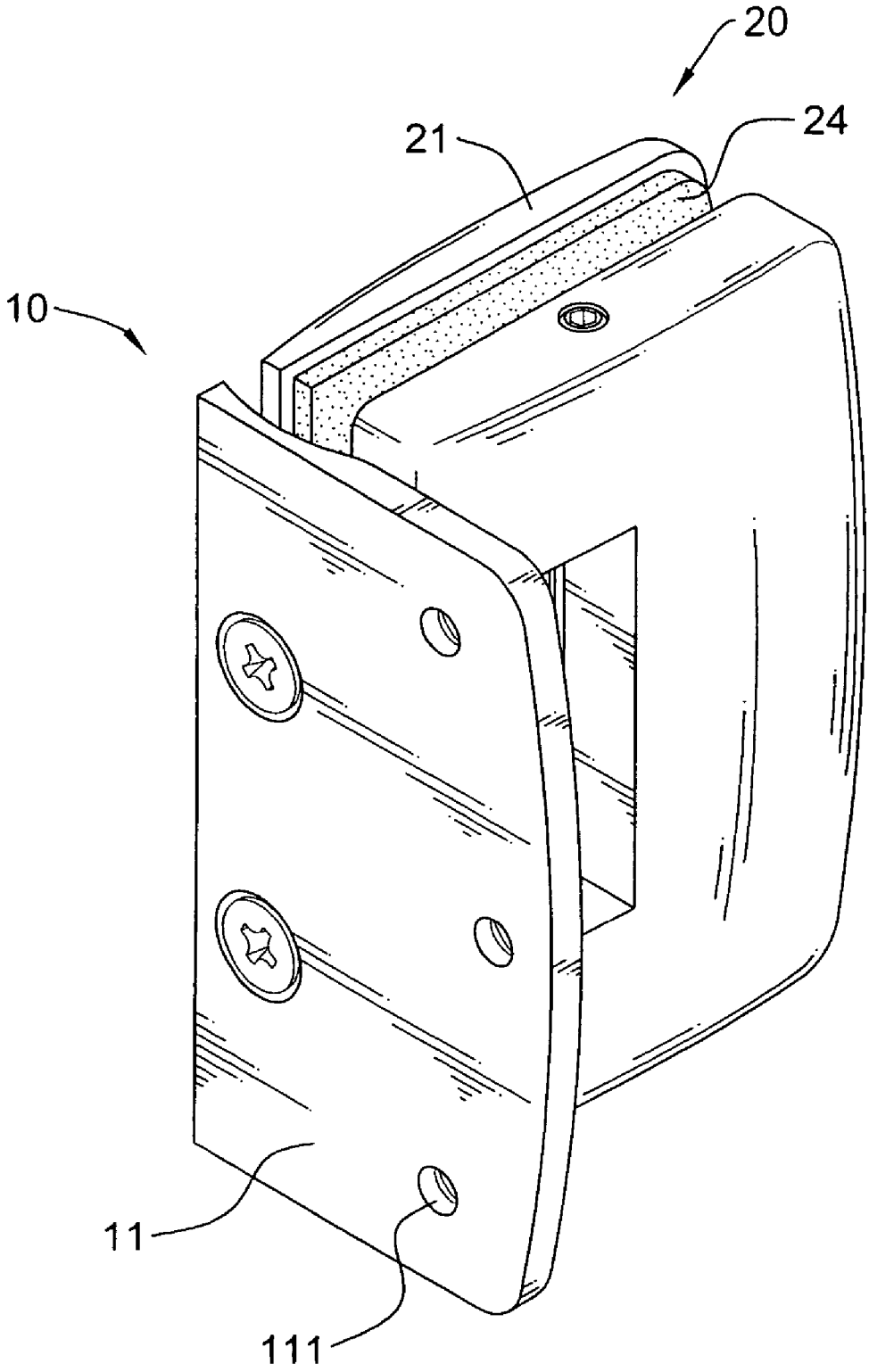
FIG. 2 is a perspective view of the adjustable hinge in FIG. 1.

With reference to FIGS. 1 and 2, an adjustable hinge in accordance with the present invention comprises a stationary bracket (10) and a clamp assembly (20).

The stationary bracket (10) has a doorframe mount (11), a pivot pin bracket (12), a sliding actuator (14) and at least one resilient element.

The doorframe mount (11) has an outside surface, an inside surface and multiple mounting holes (111) defined through the doorframe mount (11).

The pivot pin bracket (12) is attached to the inside surface of the doorframe mount (11) and has a top, a bottom (not shown), an outside end, a pin hole (121), an actuator slot (122) and two bushings (123). The pin hole (121) is defined vertically through the pivot pin bracket (12). The actuator slot (122) is defined horizontally in the outside end of the pivot pin bracket (12) and communicates with the pin hole (121). The bushings (123) are mounted respectively on the top and bottom of the pivot pin bracket (12) in the pivot hole (121), and each bushing (123) has a through hole corresponding coaxially with the pivot hole (121).

The sliding actuator (14) is mounted slidably in the actuator slot (122) and has an outside end, a flat inside end and two posts (141). The flat inside end is opposite to the outside end. In a preferred embodiment of the sliding actuator (14), the two posts (141) are formed on the outside end of the sliding actuator (14).

The at least one resilient element is mounted between the inside surface of the doorframe mount (11) and the outside end of the sliding actuator (14). In a preferred embodiment of the hinge, the at least one resilient element is two springs (15) mounted respectively around the posts (141) on the sliding actuator (14).

The clamp assembly (20) is mounted pivotally on the stationary bracket (10) and has a first clamp assembly, a second clamp (22), two clamp fasteners (23), two gaskets (24) and a clamp cover (27).

The first clamp assembly is mounted pivotally on the stationary bracket (10) and has a body (21), a pivot pin (29), two pivot pin clamps (25) and two pairs of pivot pin clamp bolts (26).

The body (21) is mounted pivotally on the pivot pin bracket (12), is C-shaped and has an inside surface, a proximal end, a distal end, a mounting recess (211), a protrusion (212), two pivot pin clamp sockets (214), two pivot pin sockets (215) and two pairs of threaded pivot pin clamp holes (216). A preferred embodiment of the first clamp further has two threaded clamp holes (213).

The mounting recess (211) is defined in the proximal end of the body (21). The protrusion (212) is formed on the inside surface of the body (21) along and adjacent to the mounting recess (211) and has an inside surface. The pivot pin clamp sockets (214) are defined in the inside surface of the protrusion (212) close to the proximal end of the body (21), are separated by the mounting recess (211) and are aligned vertically. The threaded pivot pin clamp holes (216) are defined in the inside surface of the protrusion (212) respectively in the pivot pin clamp sockets (214). The pivot pin sockets (215) correspond to the pairs of the threaded pivot pin clamp holes (216) and are defined in the inside surface of the protrusion (212) respectively in the pivot pin clamp sockets (214) between the threaded pivot pin clamp holes (216) of the corresponding pair. The threaded clamp holes (213) are defined in the inside surface of the protrusion (212) close to the distal end of the body (21).

The pivot pin (29) is mounted securely in the body (21) of the first clamp assembly, rotatably extends through the pin hole (121) in the pivot pin bracket (12) and has two ends and a longitudinal flat face (291). The ends of the pivot pin (29) extending respectively through the through holes in the bushings (123) and are mounted respectively in the pivot pin sockets (215) in the body (21) of the first clamp assembly. The longitudinal flat face (291) is defined in the pivot pin (29) and corresponds to the flat inside end of the sliding actuator (14). The bushings (123) hold the pivot pin (29) in the pin hole (121) and allow the pivot pin (29) to smoothly rotate without binding in the pin hole (121).

The pivot pin clamps (25) correspond to and are mounted respectively in the pivot pin clamp sockets (214) and securely hold the ends of the pivot pin (29) in the body (21) of the first clamp assembly. Each pivot pin clamp (25) has two pivot pin clamp-mounting holes (251) and a pivot pin socket (252). The pivot pin clamp-mounting holes (251) are defined through the pivot pin clamp (25) and correspond to the threaded pivot pin clamp holes (216) in the corresponding pivot pin clamp socket (214) in the body (21). The pivot pin socket (252) in the pivot pin clamp (25) in combination with the pivot pin socket (215) in the corresponding pivot pin clamp socket (214) in the body (21) securely holds one end of the pivot pin (29).

The pairs of the pivot pin clamp bolts (26) correspond to the pivot pin clamps (25). The pivot pin clamp bolts (26) in each pair are mounted respectively through the pivot pin clamp-mounting holes (251) in the corresponding pivot pin clamp (25) and screw into the threaded pivot pin clamp holes (216) in the corresponding pivot pin clamp socket (214) in the body (21).

Figure 4:
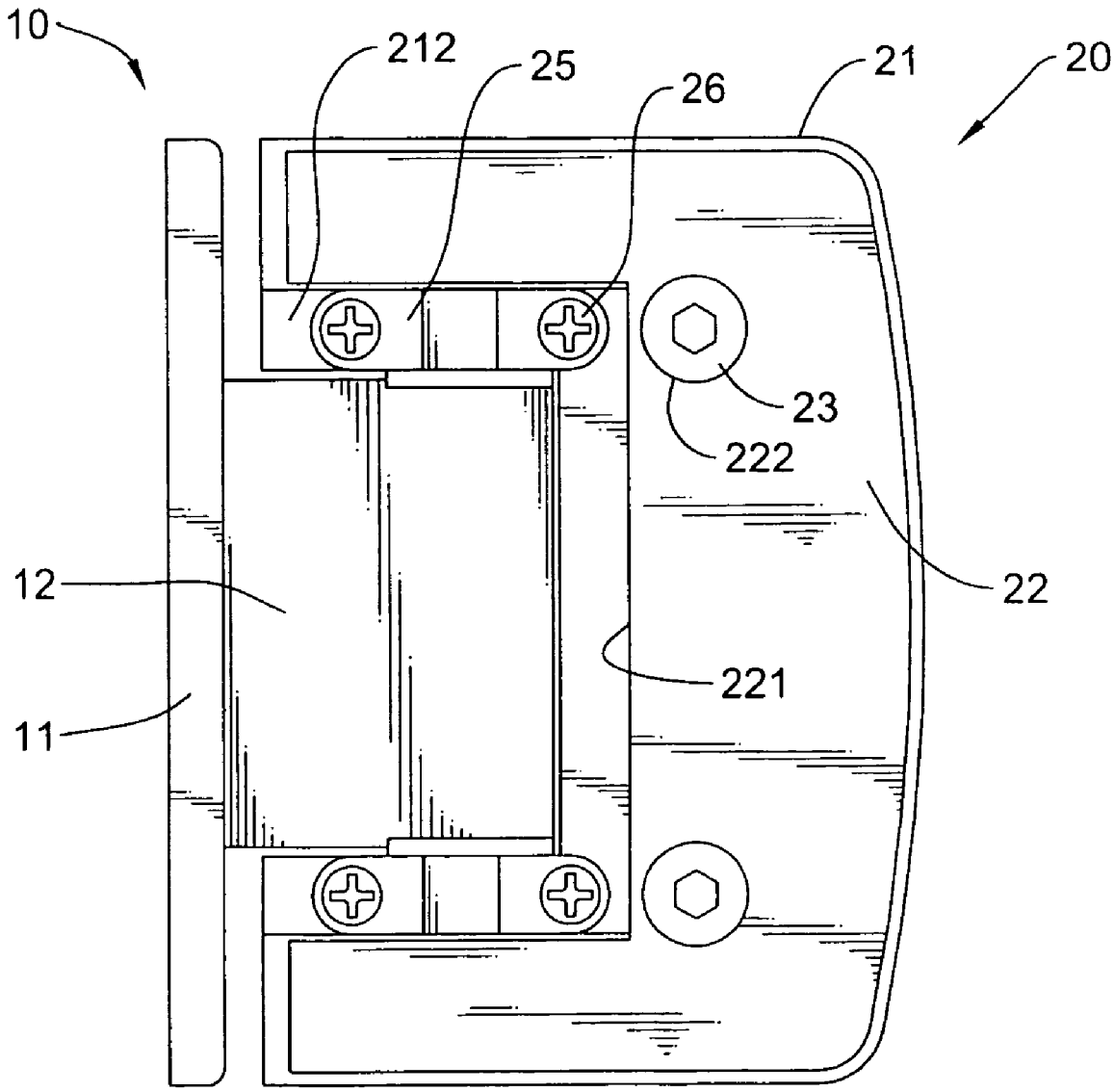
FIG. 4 is side view of the adjustable hinge in FIG. 3.

With further reference to FIG. 4, the second clamp (22) is C-shaped, is mounted on the inside surface of the body (21) of the first clamp assembly and has a top, a bottom, a proximal end, an inside surface, a mounting recess (221), two through holes (222), a top recess (223) and a bottom recess (224). The mounting recess (221) is defined in the proximal end of the second clamp (22), corresponds to the mounting recess (221) in the body (21) of the first clamp assembly and allows the clamp assembly (20) to pivot on the pivot pin bracket (12). The through holes (222) are defined through the second clamp (22). The top recess (223) is defined in the top of the second clamp (22). The bottom recess (224) is defined in the bottom of the second clamp (22).

The clamp fasteners (23) extend respectively through the through holes (222) in the second clamp (22), screw respectively into the threaded clamp holes (213) in the body (21) of the first clamp assembly and securely hold the second clamp (22) on the inside surface of the body (21). A preferred embodiment of the clamp fasteners (23) are two clamp bolts respectively screwing into the corresponding clamp threaded clamp holes (213) in the body (21).

The gaskets (24) are made of pliable material and are mounted respectively in the inside surface of body (21) of the first clamp assembly and the inside surface of the second clamp (22) adjacent to the protrusion (212).

The clamp cover (27) is mounted on the second clamp (22) and has a top, a bottom, an inside surface, a clamp recess (270), a top threaded hole (271), an alignment protrusion (272) and a cover bolt (273). The clamp recess (270) is defined in the inside surface of the clamp cover (27) and corresponds to the second clamp (22). The top threaded hole (271) is defined through the top of the clamp cover (27), corresponds to the top recess (223) in the second clamp (22) and communicates with the clamp recess (270). The alignment protrusion (272) is formed in the clamp recess (270) adjacent to the bottom of the clamp cover (27) and corresponds to the bottom recess (224) in the second clamp (22). The cover bolt (273) screwing through the top threaded hole (271) in the clamp cover (27), extends in the top recess (223) in the second clamp (22) and cooperates with the alignment protrusion (272) to securely hold the clamp cover (27) on the second clamp (22).

Figure 3:
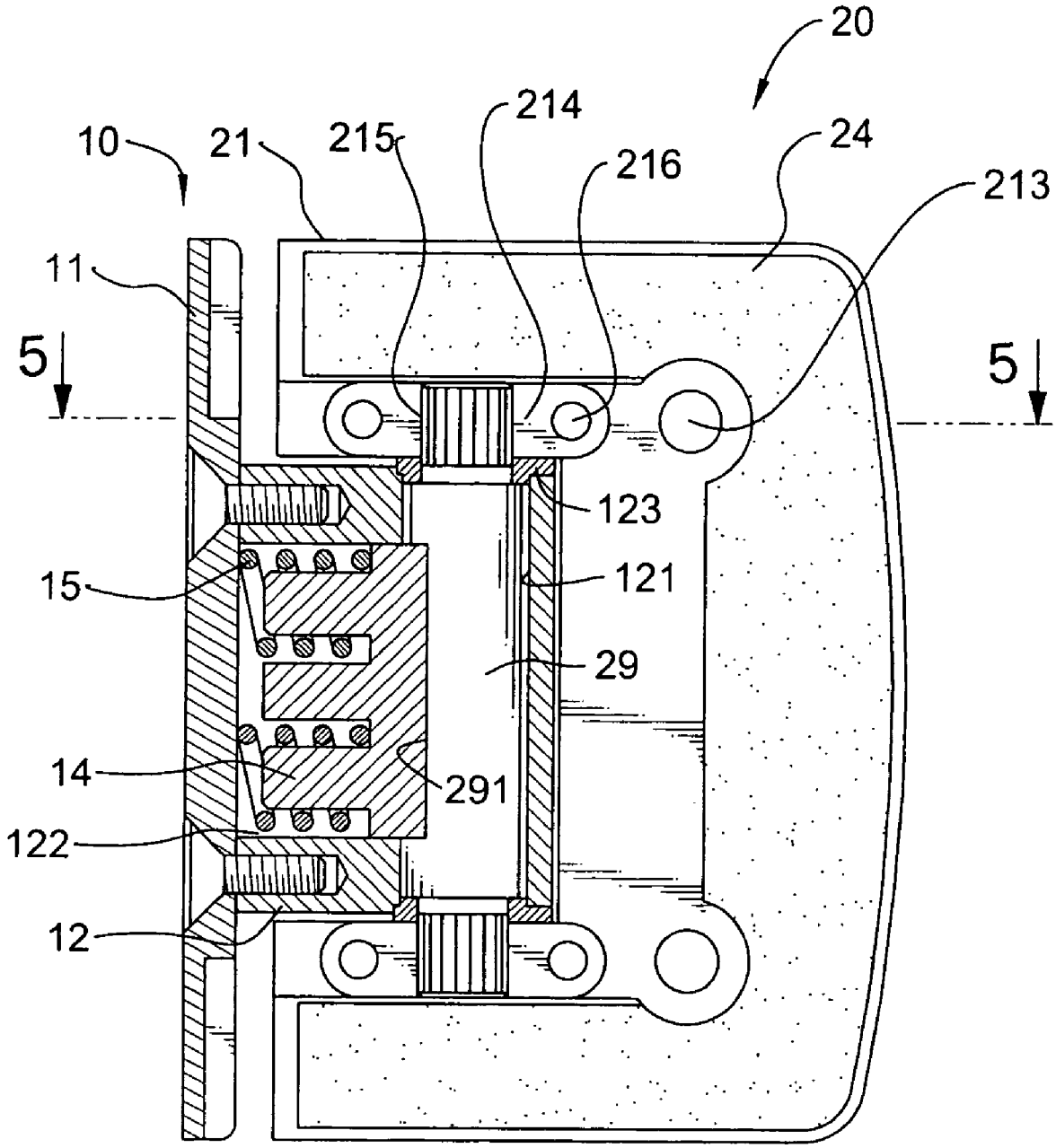
FIG. 3 is a cross sectional side view of the adjustable hinge in FIG. 2.
Figure 5:
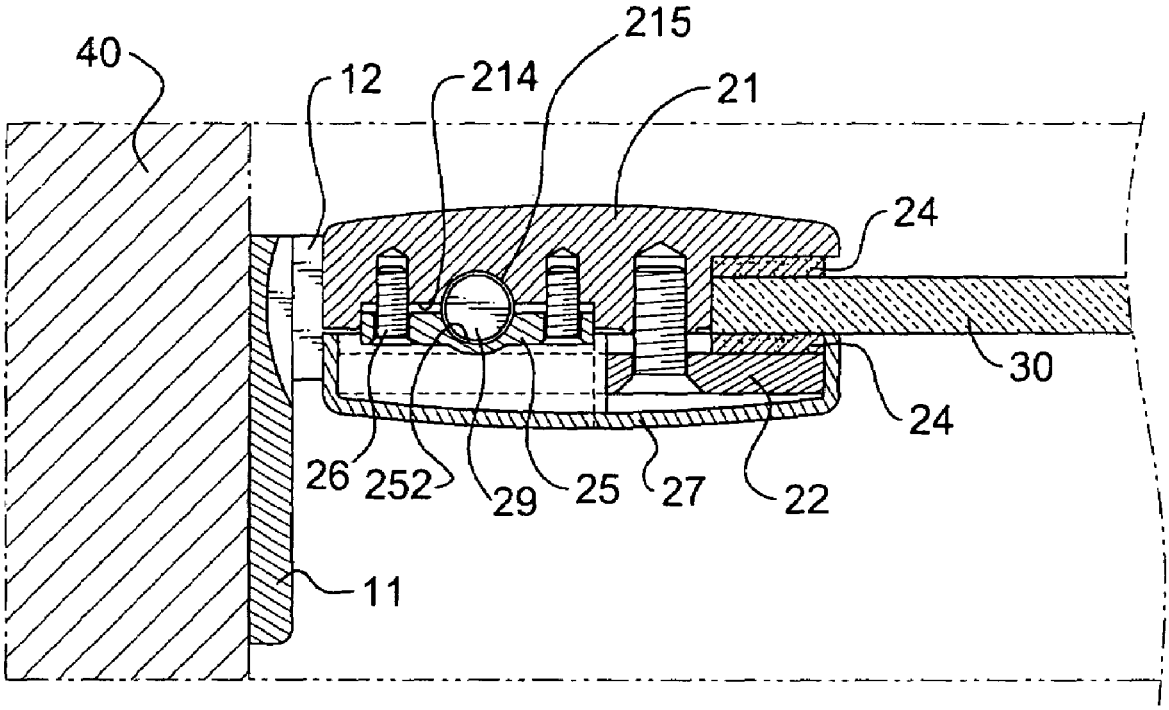
FIG. 5 is a cross sectional top view of the adjustable hinge along line 5—5 in FIG. 3 mounted on a doorframe.
Figure 6:
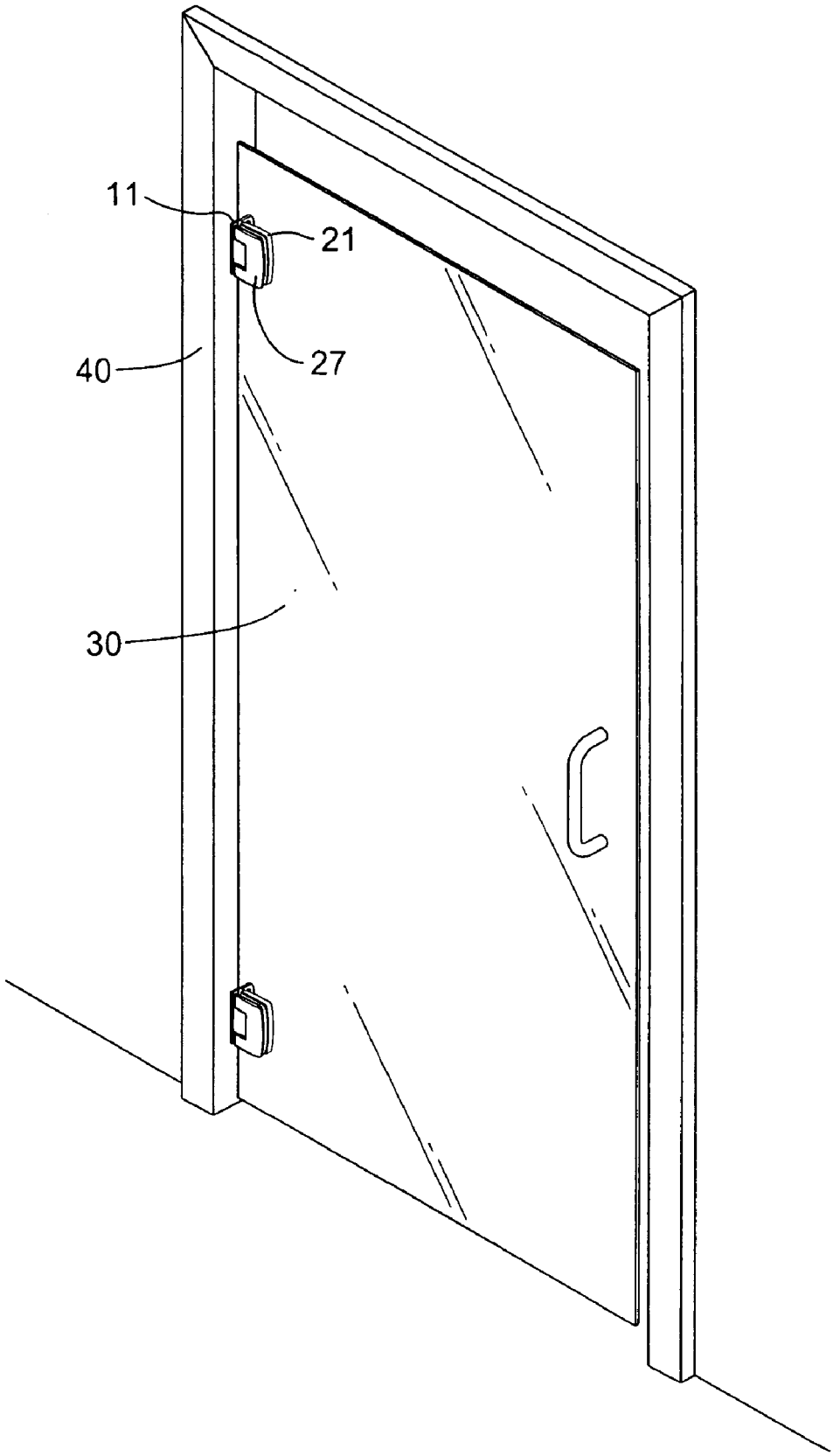
FIG. 6 is a perspective view of the glass door with the adjustable hinges in FIG. 4 in a doorframe.

With reference to FIGS. 3, 5 and 6, two adjustable hinges are used with a doorframe (40) and a glass door (30). The doorframe mounts (11) of the adjustable hinges are mounted securely on the doorframe (40) with multiple bolts extending respectively through the mounting holes (111) in the doorframe mounts (11). The glass door (30) is held securely between the gaskets (24) on the inside surfaces respectively of the body (21) of the first clamp assembly and the second clamp (22) of each adjustable hinge.

One of the adjustable hinges is adjusted to align the glass door (30) with the doorframe (40) with a simple four step process comprising aligning the sliding actuator (14) with the pivot pin (29), loosening the pivot pin clamp bolts (26), aligning the glass door (30) with the doorframe (40), and tightening the pivot pins (29) the pivot pin clamp bolts (26).

Figure 7:
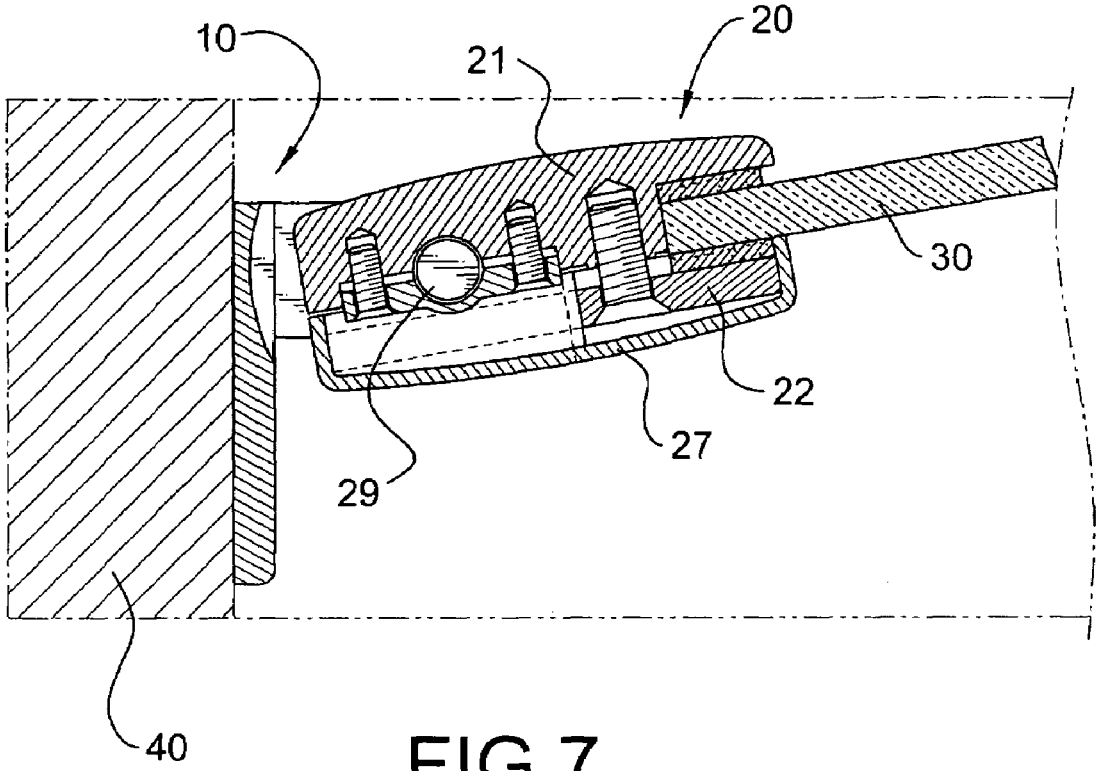
FIG. 7 is an operational top view of the adjustable hinge in FIG. 6.

With reference to FIG. 7, the glass door rotates (30) relative to the doorframe (40) to cause the alignment of the longitudinal flat face (291) of the pivot pin (29) with the flat inside end of the sliding actuator (14) of the adjustable hinge.

Figure 8:
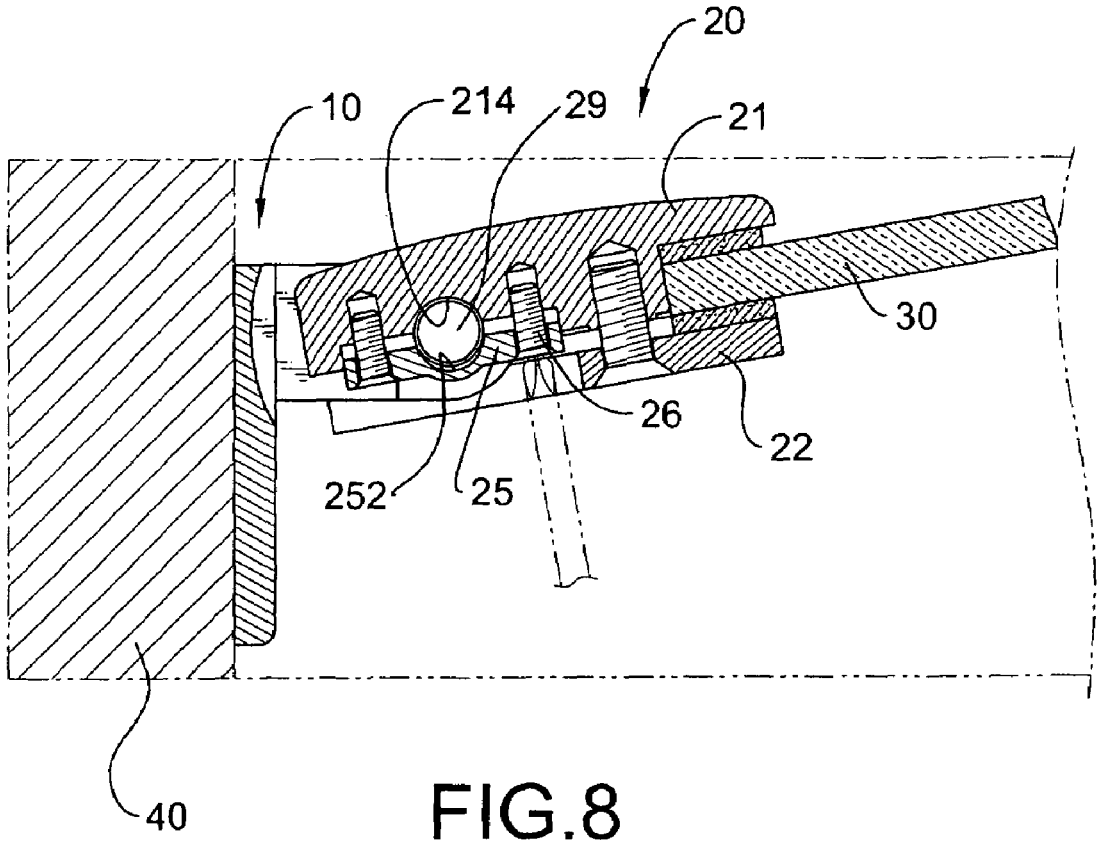
FIG. 8 is an operational top view of the adjustable hinge in FIG. 7.

With reference to FIG. 8, the pivot pin clamp bolts (26) are loosened with a screwdriver to release the pivot pin (29) from the pivot pin clamps (25) in the body (21) of the first clamp assembly.

Figure 9:
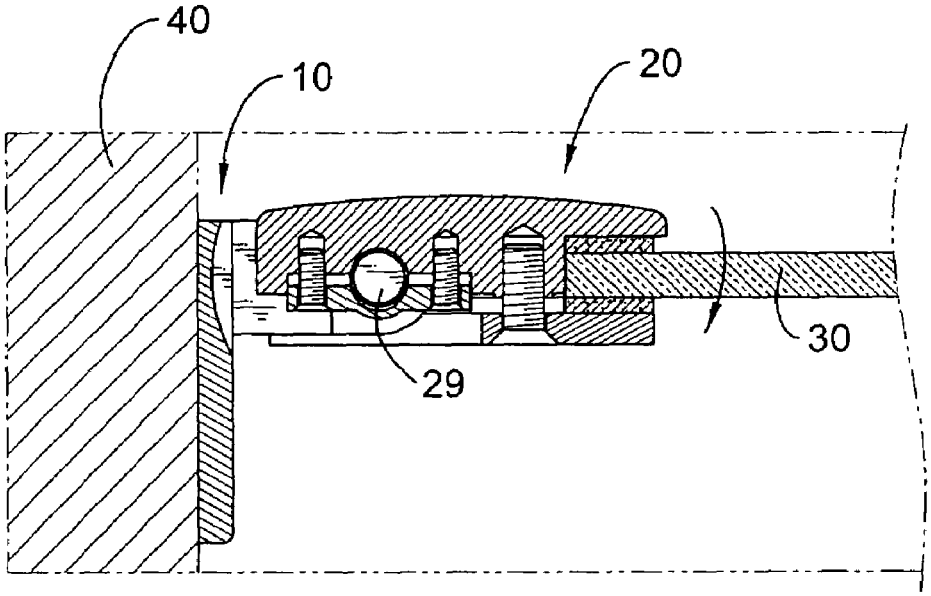
FIG. 9 is an operational top view of the adjustable hinge in FIG. 8.

With reference to FIG. 9, the glass door (30) rotates relative to the released pivot pin (29) to align with the doorframe (40).

Figure 10:
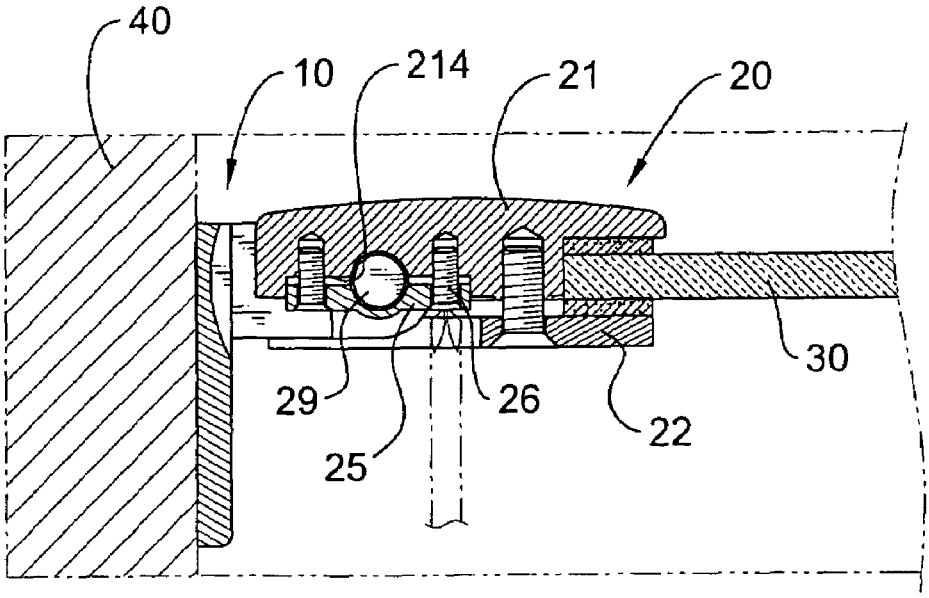
FIG. 10 is an operational top view of the adjustable hinge in FIG. 9.

With reference to FIG. 10, the pivot pin (29) is attached securely to the body (21) of the first clamp assembly by tightening the pivot pin clamp bolts (26) in the pivot pin clamps (25).

Aligning the glass door (30) to the doorframe (40) is quick simple when the adjustable hinge is used.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. An adjustable hinge for a glass door comprising:

a stationary bracket having a doorframe mount having an outside surface, an inside surface and multiple mounting holes defined through the doorframe mount;

a pivot pin bracket attached to the inside surface of the doorframe mount and having a top;

a bottom;

an outside end;

a pin hole defined vertically through the pivot pin bracket; and an actuator slot defined horizontally in the outside end of the pivot pin bracket and communicating with the pin hole;

a sliding actuator mounted slidably in the actuator slot and having an outside end and a flat inside end opposite to the outside end; and at least one resilient element mounted between the inside surface of the doorframe mount and the outside end of the sliding actuator; and a clamp assembly mounted pivotally on the stationary bracket and having a first clamp assembly mounted pivotally on the stationary bracket and having a body being C-shaped, mounted pivotally on the pivot pin bracket and having an inside surface;

a proximal end;

a distal end;

a mounting recess defined in the proximal end of the body;

a protrusion formed on the inside surface of the body along and adjacent to the mounting recess and having an inside surface;

two pivot pin clamp sockets defined in the inside surface of the protrusion close to the proximal end of the body, separated by the mounting recess and aligned vertically;

two pairs of threaded pivot pin clamp holes defined in the inside surface of the protrusion respectively in the pivot pin clamp sockets; and two pivot pin sockets corresponding to the pairs of the threaded pivot pin clamp holes and defined in the inside surface of the protrusion respectively in the pivot pin clamp sockets between the threaded pivot pin clamp holes of a corresponding pair;

a pivot pin mounted securely in the body of the first clamp assembly, rotatably extending through the pin hole in the pivot pin bracket and having two ends mounted respectively in the pivot pin sockets in the body of the first clamp assembly; and a longitudinal flat face defined in the pivot pin and corresponding to the flat inside end of the sliding actuator;

two pivot pin clamps corresponding to and mounted respectively in the pivot pin clamp sockets and securely holding the ends of the pivot pin in the body, and each pivot pin clamp having two pivot pin clamp-mounting holes defined through the pin pivot pin clamp and corresponding to the threaded pivot pin clamp holes in a corresponding pivot pin clamp socket in the body; and a pivot pin socket in combination with the pivot pin socket in the corresponding pivot pin clamp socket in the first clamp securely holding one end of the pivot pin;

two pairs of pivot pin clamp bolts corresponding to the pivot pin clamps, and the pivot pin clamp bolts of each pair mounted respectively through the pivot pin clamp-mounting holes in a corresponding pivot pin clamp and screwing into the threaded pivot pin clamp holes in a corresponding pivot pin clamp socket in the body;

a second clamp being C-shaped, mounted on the inside surface of the clamp and having a top;

a bottom;

a proximal end;

an inside surface;

a mounting recess defined in the proximal end of the second clamp, corresponding to the mounting recess in the body of the first clamp assembly and allowing the clamp assembly to pivot on the pivot pin bracket; and two through holes defined through the second clamp; and two clamp fasteners extending respectively through the through holes in the second clamp, screwing respectively into threaded clamp holes in the body of the first clamp assembly and securely holding the second clamp on the inside surface of the body of the first clamp assembly.

2. The adjustable hinge as claimed in claim 1, wherein:

the sliding actuator further has two posts formed on the outside end of the sliding actuator; and the at least one resilient element is two springs mounted respectively around the posts.

3. The adjustable hinge as claimed in claim 2, wherein the clamp assembly further has two gaskets made of pliable material and mounted respectively in the inside surface of body of the first clamp assembly and the inside surface of the second clamp adjacent to the protrusion.

4. The adjust hinge as claimed in claim 3, wherein:

the second clamp further has a top recess defined in the top of the second clamp; and a bottom recess defined in the bottom of the second clamp;

the clamp assembly further has a clamp cover mounted on the second clamp and having a top;

a bottom;

an inside surface;

a clamp recess defined in the inside surface of the clamp cover and corresponding to the second clamp;

a top threaded hole defined through the top of the clamp cover, corresponding to the top recess in the second clamp and communicating with the clamp recess;

an alignment protrusion formed in the clamp recess adjacent to the bottom of the clamp cover and corresponding to the bottom recess in the second clip; and a cover bolt screwing through the top threaded hole in the clamp cover, extending in the top recess in the second clamp and cooperating with the alignment protrusion to securely hold the clamp cover on the second clamp.

5. The adjust hinge as claimed in claim 4, wherein:

the threaded clamp holes are defined in the inside surface of the protrusion close to the distal end of body of the first clamp assembly; and the clamp fasteners are two clamp bolts screwing respectively into the corresponding threaded clamp holes in the body of the first clamp assembly.

6. The adjustable hinge as claimed in claim 5, wherein the pivot pin further has two bushings mounted respectively on the top and bottom of the pivot pin bracket in the pivot pin hole, and each bushing has a through hole corresponding coaxially with the pivot hole and through which one end of the pivot pin extends.

* * * * *